US007182230B2

(12) United States Patent
Kelley et al.

(10) Patent No.: US 7,182,230 B2
(45) Date of Patent: Feb. 27, 2007

(54) RESEALABLE CLOSURE SYSTEM

(75) Inventors: Paul Kelley, Thurmont, MD (US); Seungyeol Hong, Plainfield, IL (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 10/795,510

(22) Filed: Mar. 9, 2004

(65) Prior Publication Data

US 2004/0178231 A1 Sep. 16, 2004

Related U.S. Application Data

(60) Provisional application No. 60/453,205, filed on Mar. 11, 2003.

(51) Int. Cl.
*B67D 3/00* (2006.01)

(52) U.S. Cl. ..... 222/521; 222/519; 222/522; 222/525

(58) Field of Classification Search ..... 222/521, 222/525, 522, 519, 520; 215/216–217
See application file for complete search history.

(56) References Cited

U.S. PATENT DOCUMENTS 2,998,902 A * 9/1961 Thomas et al. ..... 222/499
3,216,630 A * 11/1965 Stull ..... 222/499
3,834,596 A 9/1974 Brady et al.
4,171,749 A 10/1979 Obrist et al.
4,867,354 A * 9/1989 Schreiber ..... 222/521
5,609,276 A 3/1997 Greatbatch
5,743,444 A * 4/1998 Beck et al. ..... 222/521
5,810,185 A * 9/1998 Groesbeck ..... 215/387
5,944,234 A 8/1999 Lampe et al.
6,286,733 B1 9/2001 Francois
6,334,555 B1 * 1/2002 Randall et al. ..... 222/521
6,477,743 B1 11/2002 Gross et al.

OTHER PUBLICATIONS

International Preliminary Examination Report, Sep. 29, 2005.

* cited by examiner

*Primary Examiner*—Frederick C. Nicolas
(74) *Attorney, Agent, or Firm*—Venable LLP; Keith G. Haddaway

(57) ABSTRACT

A resealable closure system that includes a neck having a finish and a closure. The system includes mechanisms for sealing the container and maintaining the container in a closed position, which may be the same. The system can also include a means for preventing the closure from detaching from the container. The finish has an end that includes a post, an opening and a retaining ring, a recess defined by the retaining ring, and a shoulder. The closure slides onto the neck and has a sleeve that is about the same outside size as the neck. The sleeve has a stop on its interior surface. The top part of the closure has a receptacle to receive the post on the finish.

33 Claims, 8 Drawing Sheets

RESEALABLE CLOSURE SYSTEM

BACKGROUND OF THE INVENTION

1. Field of the Invention

The present invention is a resealable closure for containers. More particularly the present invention is a resealable closure for plastic containers which is adapted to be opened and closed with one hand.

2. Related Art

Containers for holding and dispensing fluids such as drinks, motor oils, detergents, shampoos, household products, and free flowing solids, for example free-flowing powders, preferably have resealable closures. Resealable closures are desirable because they allow the closure to be replaced on the container if all of the container contents have not been dispensed. Thus, such containers can contain more than a single use amount of material, resulting in decreased packaging costs. Another advantage of resealability is the ability to reuse containers.

Two common and well known types of resealable closures are threaded closures and friction fit or snap-fit closures. Threaded closures have been in existence for many years. In a threaded closure, a finish on the container, for example at the neck of a container, has external threads. A cap, or closure, is adapted to engage the threads of the finish for attachment to the container. This can be, for example, a projection in the closure or matching threads on a corresponding interior surface of the closure. In a friction fit or snap-fit closure system, the finish comprises an externally projecting ring that engages an inward facing projection on the closure. When the closure is forced onto the finish, the inward facing ring on the closure is forced to a position below the externally projecting ring on the finish. As a result, the closure stays on the container unless sufficient force is applied to push the inward facing ring back over the externally projecting ring on the finish. This arrangement, which requires the use of resilient material for the externally projecting ring on the finish and/or the inward facing ring on the closure, has been facilitated by the use of plastic bottles.

These two closure systems suffer several drawbacks. For example, two hands are often required to open and reseal the container. Furthermore, the use of separate pieces can result in the two components being separated and the closure lost. One solution to this problem is the use of closures that are connected to the finish by a hinge. However, even in this case, opening and resealing may be cumbersome.

Another solution to the problems encountered with threaded and friction fit closures is a closure system that opens and closes by sliding. These types of resealable closures are commonly used on bottles manufactured for "sports drinks" (i.e., beverages that are intended to replace electrolytes lost from the body though physical activity) and on water bottles. Water bottles can be containers specifically manufactured to contain water to be sold as a commodity and empty bottles that are designed for reuse and may be adapted for attachment to a holder on a bicycle.

In these types of closure systems, the finish of the bottle contains a thread. The closure generally consists of two pieces, a base and a cap. The base has threads that allow it to be attached to the bottle. Some of these systems can also use a friction fit or snap-fit arrangement to attach the base to the finish instead of a thread. On the other end of the base, there is a post surrounded by openings through which the product can flow. The cap has a receptacle for the post and is designed to slide up and down on the base. Typically, the cap resembles a column with a cone attached to the top. The base of the cone has a larger diameter than the column to create a mushroom-like appearance. The extra width of the cone provides a grip point on the cap for the user to grab in order to slide the cap up and down. When the cap is pushed toward the bottle, the receptacle tightly engages the post of the base and creates a seal. When the cap is moved up, the receptacle moves away from the post and the product can flow out the openings in the base, around the post and out the now open receptacle.

Although these types of systems provide resealabilty, there are several disadvantages. First, the use of a separate base and bottle can undesirably add manufacturing costs. Many of the current systems of this type require a base that is approximately the same size as a typical closure for these bottles. The cap is an additional piece at an additional cost. An even greater disadvantage of such systems is that two hands are generally required to open the container, although many users also use their teeth to grip the cone of the cap and open the bottle and then push it against some solid object to reclose the cap. The use of one's teeth to open and close the cap can result in wear on the cap. Further, although this is suitable for beverages or other edible products, a user is unlikely to use their teeth to open a cap if the container contained motor oil, detergent or some toxic substance, and two hands are therefore required.

What is needed is a closure system that avoids these disadvantages in the art. In particular, there remains a need for resealable closure systems that are simple and require a limited number of easily formed pieces in order to be cost-effective to manufacture. There is also a need for closure systems that can be opened and closed with one hand while gripping the container.

BRIEF SUMMARY OF THE INVENTION

In summary, the present invention provides an easily manufactured resealable closure system. The components of the closure can be manufactured and assembled in a cost-effective manner. The closure system is particularly well suited for opening and closing with one hand.

The present invention differs from the prior art in modifications, which were not previously known or suggested. In particular, prior systems utilize a closure that is made from two relatively large parts, a base and a cap. The cap is generally shaped and sized in such a way that it cannot be opened and closed with one hand. The present invention improves on this by providing a closure that has a sleeve that terminates near the bottle neck, making it capable of being opened and closed with one hand.

The present invention is a resealable closure system that includes a neck having a finish and a closure. In general, the system requires a mechanism for sealing the container and a mechanism for maintaining the container in a closed position. The mechanisms may be the same. For example, a snuggly fitting post will help keep the container closed. The system also should include a means for preventing the closure from detaching from the container.

The finish has an end connected to the neck and an end distal to the neck that includes a post, an opening; and a retaining ring. The finish also has a recess defined by the retaining ring and a lower shoulder. The closure connects to the neck by sliding over at least a part of the finish. The top part of the closure has a receptacle, which is typically located at the center, to receive the post on the finish so that a seal between the post and receptacle is formed when the system is closed. The closure also includes a sleeve with an outer dimension that is about the same as the outer dimension of the neck. The sleeve also has a stop on its inner surface that retains the closure on the finish. The lower shoulder can be parallel to the retaining ring or can be at an angle to the retaining ring. For ease of opening, the closure can also include a thumb push. The closure can also include a seal on an inner surface of the top part that fits into the opening in the finish when the system is closed. The closure can also include a second stop. In this arrangement, the second stop can contact the ring to help hold the system in a closed position.

The finish can be made from two pieces, a finish insert and an open finish. A skirt on the insert fits into an opening of the open finish. Generally, the post and openings are on the insert and the recess and shoulder are on the open finish. The retaining ring may either be part of the insert or part of the open finish. The open finish can also include a ridge upon which a sealing ring at the outer periphery of the insert rests. The sealing ring can sit within an inset defined by the ridge and an additional rim on the open finish.

The invention is also a container, typically plastic, that includes the closure system. The system may be part of the container; for example, the neck and finish may be formed on the container. The containers also have a base and a body. The body of the container can be any shape including cylindrical, rectangular and elliptical. The neck may be along the center line of the container or offset from the center line. Containers according to the invention may be used for, for example, oil (especially motor oil), detergent, beverages and free flowing powders.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

A preferred embodiment of the invention is discussed in detail below. While specific exemplary embodiments are discussed, it should be understood that this is done for illustration purposes only. A person skilled in the relevant art will recognize that other components and configurations can be used without parting from the scope of the invention. In describing embodiments, specific terminology is employed for the sake of clarity. However, the invention is not intended to be limited to the specific terminology so selected.

Figure 1A:
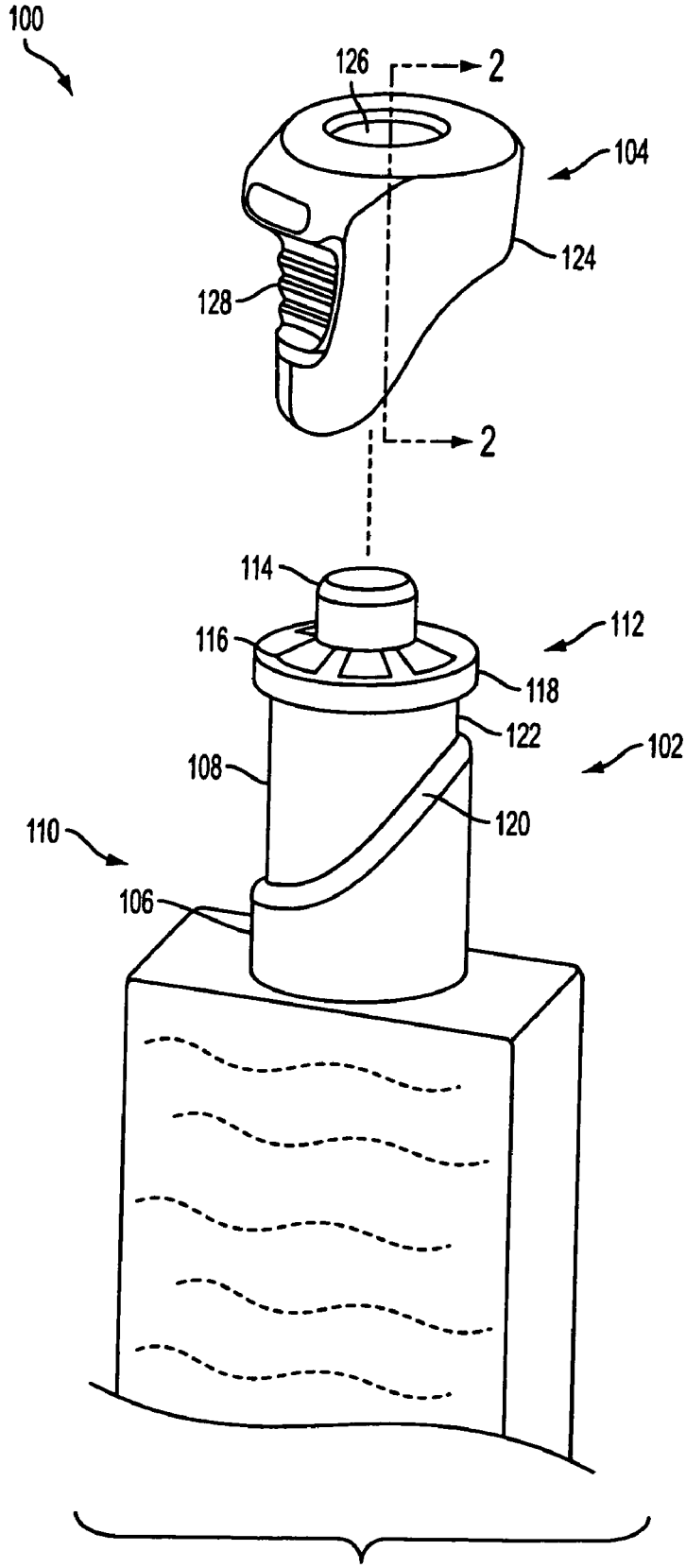
FIGS. 1A and 1B depict exploded plan views of exemplary embodiments of the closure system of the invention.

As depicted in the exemplary embodiment shown in exploded plan view of FIG 1A, the present invention is a resealable closure system 100 that includes a bottle end 102 and a closure 104. The bottle end 102 comprises a neck 106 with finish 108. The neck 106 and finish 108 can be manufactured as part of a container or can be attachable to a container. The finish 108 has a first end 110 continuous with the neck 106 and a second end 112 distal to the neck 106. The second end 112 of the finish 108 has a retaining ring 118, formed as an annular ring, a post 114 and at least one opening 116. The post 114, which can be centrally located on the second end 112, is adapted to sealingly engage a receptacle 126 on the closure 104 to prevent escape of the contents from a container to which the resealable closure system 100 is attached. The finish further comprises a lower shoulder 120, which, together with the retaining ring 118, defines a recess 122 in the finish 108. As described below, the retaining ring 118 and recess 122 engage internal structures of the closure 104 to allow the closure 104 to slide up and down the finish, i.e. away from and toward the neck 106.

In addition to the receptacle 126 located at an end of the closure 104, the closure 104 also comprises a sleeve 124. The sleeve 124 is adapted to fit over the finish 108 and to have an outer dimension that is about the same as the outer dimension of the neck 106. For example, if the neck 106 is tubular with a certain diameter, the sleeve 124 will also be approximately tubular and can have approximately the same diameter as the neck 106. This sizing and arrangement of the finish 108, neck 106 and sleeve 124 allow the closure system to be opened and closed with one hand while that same hand grasps the neck 106 or the container to which the neck 106 is attached. To further facilitate ease of opening the closure 104, thumb push 128 can optionally be molded into the sleeve. FIG. 1A depicts one configuration of the thumb push 128, but this feature is not limited to this configuration and any suitable feature that facilitates opening can be used.

Figure 1B:
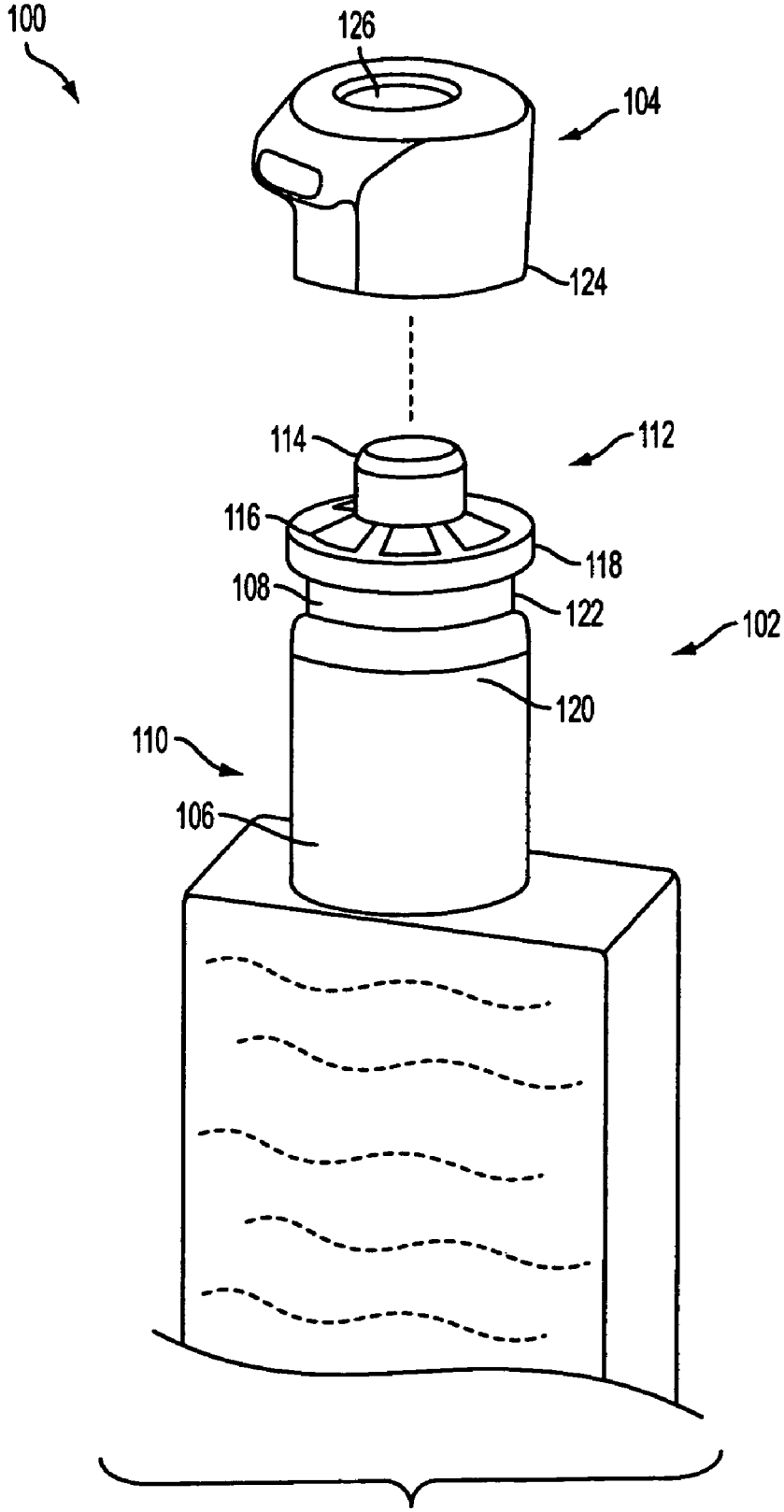
Figure 2:
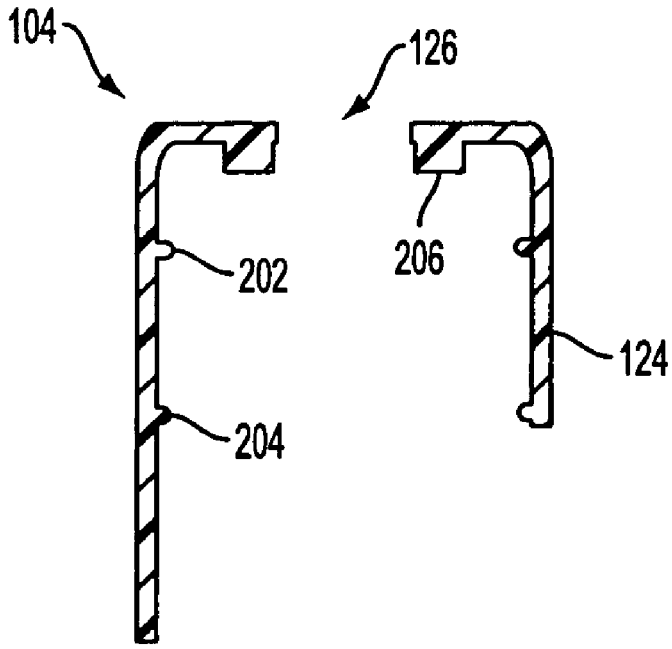
FIG. 2 depicts an exemplary embodiment of a cross-sectional view of a closure according to the present invention.

FIG. 2 depicts a cross section of the closure 104 taken along the line 2—2 of FIG. 1. In the exemplary embodiment shown in FIG. 2, the interior wall of sleeve 124 has two stops. A first stop 204 is located near the end of the sleeve 124 that fits over the finish 108 and a second stop 202 is located nearer the top of the sleeve 124. Each of the two stops 202, 204 can be a continuous annular ring around the interior of the sleeve 124. Alternatively, one or both of the stops 202, 204 can be discontinuous or arc around a portion of the interior of the sleeve 124.

As also shown in FIG. 2, the closure 104 can optionally have at least one seal 206 disposed around and near the receptacle 126 on an interior surface. The seal 206 is adapted to fit into the opening 116 of the finish 108 when the closure is positioned for the receptacle 126 to sealingly engage the post 114. This provides a second seal to prevent escape of the contents from a container to which the resealable closure system 100 is attached.

Figure 3:
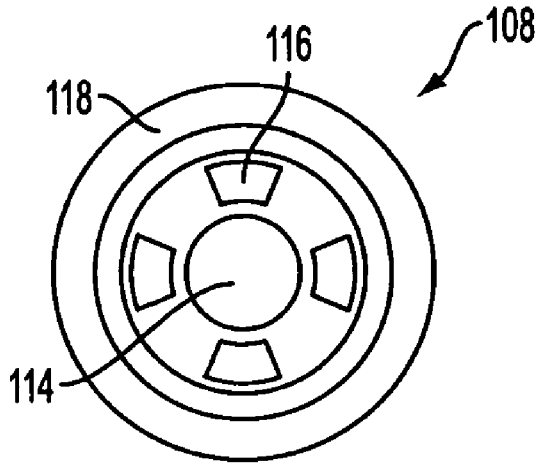
FIG. 3 depicts a top view of an exemplary embodiment of the present invention.

FIG. 3 depicts a top view of an exemplary embodiment of the finish 108 of the invention. In this exemplary embodiment, the post 114 is centrally located in a circular finish 108. The openings 116 are circumferential to the post 114. In the illustrated embodiment, there are four such openings, although a lesser or greater number can be used. The size of the openings is not limited but can be larger or smaller depending on the nature of the contents to be dispensed, the size of the closure and the finish, and the particular use. For example, for dispensing viscous liquids or powders, a fewer number of larger openings 116 would be needed as compared to the number and size of openings 116 required for dispensing a liquid product of low viscosity. The ring 118 forms the outermost portion of the upper end of the finish 108.

Figure 4B:
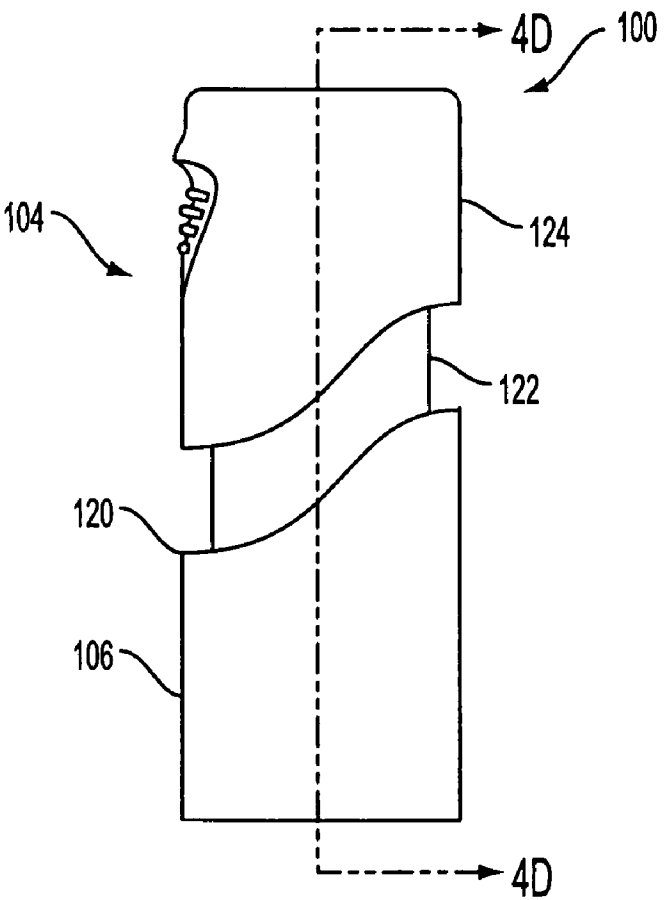
FIGS. 4A–4D depict an exemplary embodiment of the system of the invention in closed and open positions and cross-sectional views thereof.
Figure 4A:
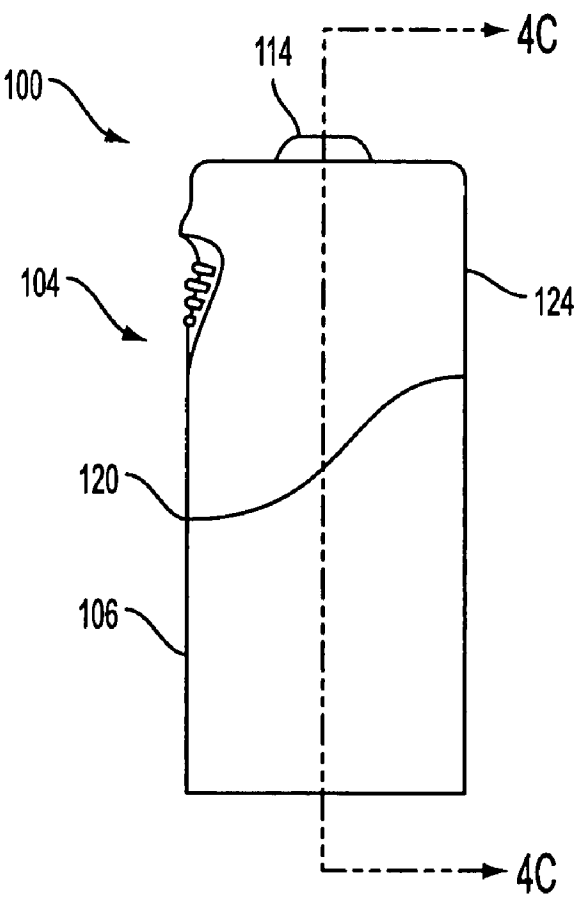

FIG. 4A is a side view of an exemplary embodiment of the closure system 100 of the invention in a closed position. In this embodiment, the post 114 protrudes through the receptacle 126 of the closure 104. As will be appreciated, the post 114 can also be of a length such that it does not protrude to the extent shown in FIG. 4A, but is more nearly flush with the top of the closure 104. As is also shown in FIG. 4A, the sleeve 124 is in contact with the lower shoulder 120 of the finish 108. The outer dimension of the closure 104 is about the same as that of the neck 106. In the embodiment shown the neck 106 forms a continuous surface with the first end 110 of the finish 108. As will be appreciated, the outer dimension of the sleeve 124 may be larger or smaller than the outer dimension of the neck 106, so long as this does not significantly affect the ability to operate the closure, i.e. open and close it, with one hand.

FIG. 4B is a side view of an exemplary embodiment of the closure system 100 of the invention in an open position. As shown in FIG. 4B, the post no longer engages or extends beyond the receptacle 126. The recess 122 is also visible below the closure 104.

Figure 4D:
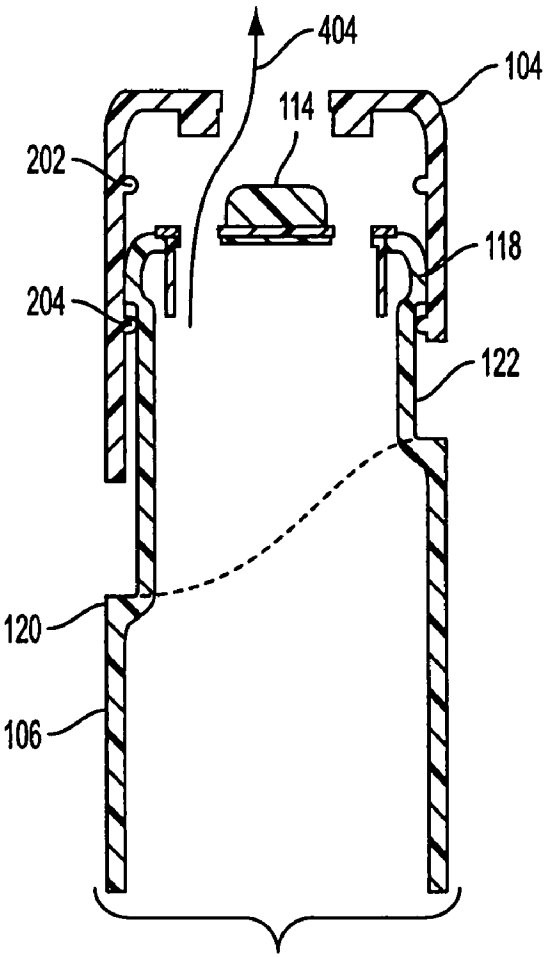
Figure 4C:
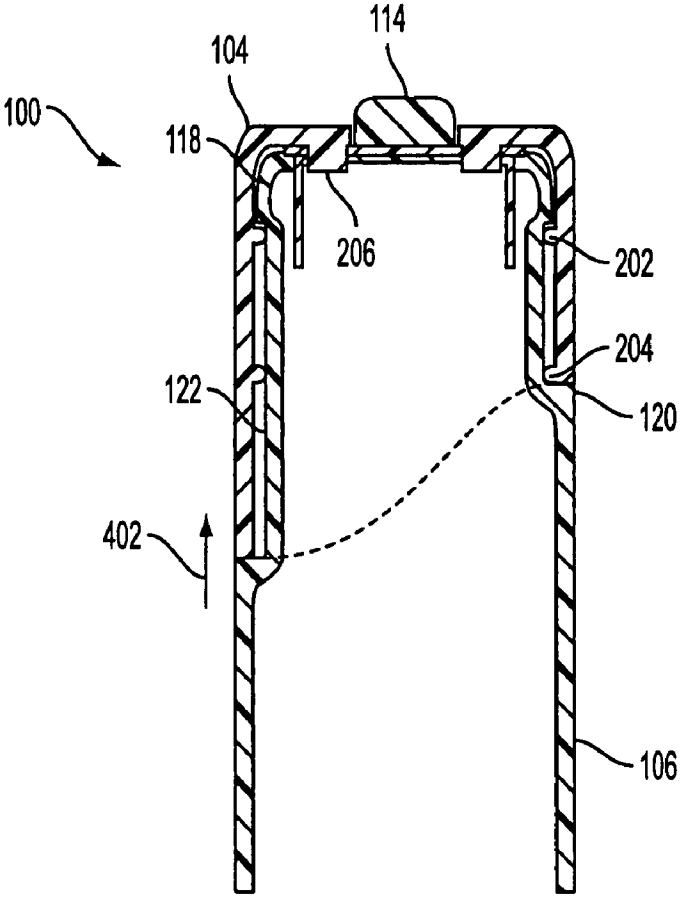

FIG. 4C is a cross section of the system 100 in a closed configuration taken along the line 4C—4C of FIG. 4A. As shown in FIG. 4C, when the closure is in a closed position, the first stop 204 and second stop 202 are both situated in the recess 122 between the retaining ring 118 and lower shoulder 120. The second stop 202 on the inner portion of the sleeve 124 is in contact with the retainer ring 118 of the finish 108. This inhibits motion in the direction depicted by arrow 402, which would allow opening of the system. The post 114 is engaged in the receptacle 126 to prevent escape of the contents from a container to which the resealable closure system 100 is attached. FIG. 4C further depicts the seal 206 in the openings 116 to further prevent escape of the contents from a container to which the resealable closure system 100 is attached. The closure system 100 is opened by forcing the closure 104 to move in the direction of arrow 402. When sufficient force is applied, the second stop 202 moves over the retainer ring 118 to push the closure 104 away from he neck 106. As can be appreciated, this requires that the sleeve 124 and/or the second stop 202 be formed from a flexible material, e.g., plastic.

Other means may be used to maintain the closure system 100 in a closed position (i.e. to inhibit motion in the direction depicted by arrow 402) other than that described above. For example, the engagement between the receptacle 126 and post 114 can be sufficient to inhibit opening, thus rendering the use of the second stop 202 unnecessary. Further, if seal 206 is present, the engagement of the seal 206 into the opening 116 can be sufficient to inhibit opening, thus rendering the use of the second stop 202 unnecessary. Similarly, the contact of the first ring 204 with a surface of the neck finish, for example in the recess 122, can be sufficiently firm to inhibit opening.

FIG. 4D is a cross section of the system 100 in an open configuration taken along the line 4D—4D of FIG. 4B. As shown in FIG. 4D, the second stop 202 is beyond the retainer ring 118. The first stop 204 is located in the recess 122 between the retaining ring 118 and lower shoulder 120. In the fully open position depicted in FIG. 4D, the first stop 204 is in contact with the retaining ring 118. Contact of the first stop 204 with the ring 118 inhibits the closure 104 from becoming disengaged from the finish 108. Other structures may similarly be used to prevent the closure 104 from becoming disengaged from the finish 108.

Further, when the system is in the open position, the post 114 is not engaged in receptacle 126. Furthermore, the seals 206, if present, are not engaged with the openings 116. Thus, when the system is in the open position, product contained within the container can escape by moving through the openings 116, around the post 114 and out the receptacle 126 as depicted by arrow 404.

Figure 5A:
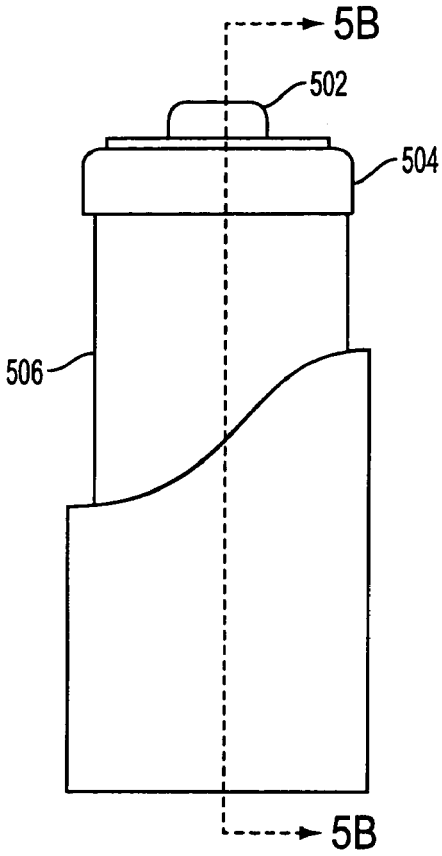
FIGS. 5A–5B depict an exemplary embodiment of the invention having a two-piece finish and a cross-sectional view thereof.
Figure 5B:
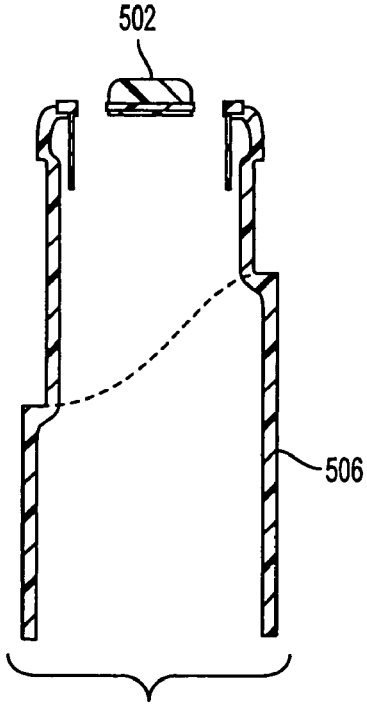
Figure 6A:
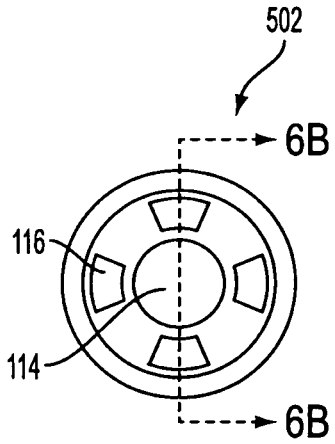
FIGS. 6A–6B depict a finish insert according to an exemplary embodiment of the invention.
Figure 6B:
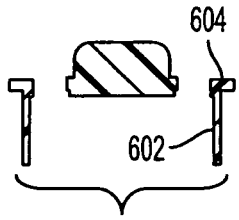

FIG. 5A depicts the finish of another exemplary embodiment of the invention. According to this embodiment, the finish comprises two pieces: a finish insert 502 that fits within an opening 504 of an open finish 506. FIG. 5B depicts a cross section of the embodiment of FIG. 5A taken along the line B—B. FIG. 6A is a top view of the finish insert 502. The finish insert 502 contains the post 114 and openings 116. FIG. 6B is a cross sectional view of the finish insert 502 taken along the line 6B—6B of FIG. 6A. As can be seen in FIG. 6B the finish insert 502 comprises a sealing ring 604 at its outer periphery that can engage the top portion of the open finish 504. Extending from and perpendicular to the sealing ring 604 is a skirt 602. The skirt is sized to fit within the opening 504 of the open finish 506 and designed to be retained in the opening 504, for example by a friction fit. Alternatively, the skirt 602 can have a ridge or other structure to allow a snap-fit engagement within the opening 504.

Figure 7:
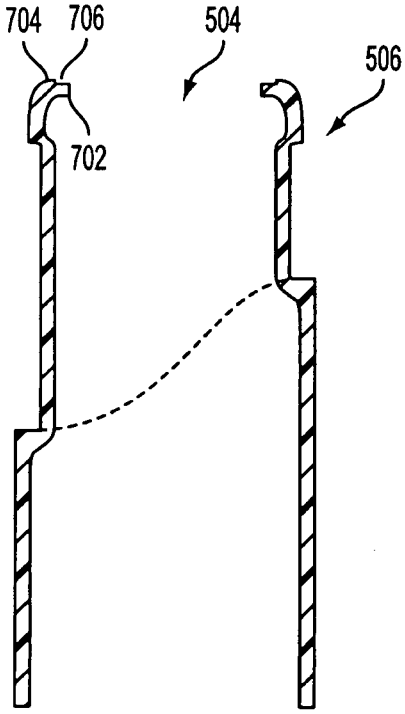
FIG. 7 depicts a finish for accepting a finish insert according to an exemplary embodiment of the invention.

FIG. 7 is a cross sectional view of the open finish 506. According to this exemplary embodiment of the open finish 506, disposed around the opening 504 as a ridge 702 on which the sealing ring 604 of the finish insert 502 can rest. The portion of the open finish 506 around the opening 504 can also have an upper rim 704. The upper rim 704 and ridge 702 are configured to form an inset 706. In this exemplary embodiment, the finish insert 502 fits in the opening 504 in such a way that the sealing ring 604 rests on ridge 702 and in inset 706, and the outer periphery of the sealing ring 604 is in contact with the upper rim 704. This engagement of the ridge 702 and upper rim 704 with the sealing ring 604 increases the amount of surface area of contact with the finish insert 502 in the open finish 506, ensuring a secure and tight seal.

Figure 8:
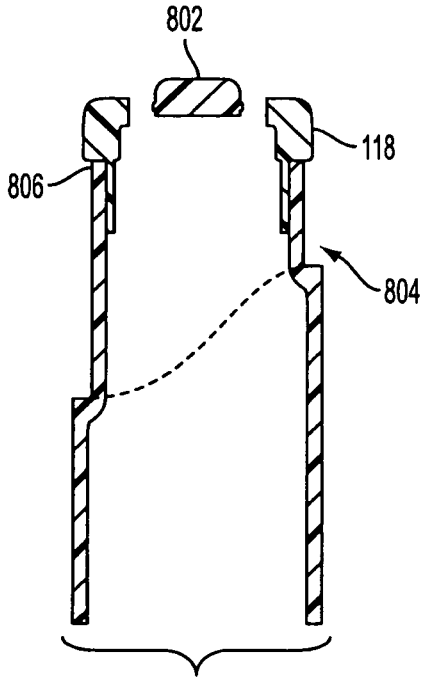
FIG 8 depicts a cross-sectional view of another exemplary embodiment of the invention having a two-piece finish.

As will be appreciated by persons skilled in the art, embodiments having a two piece finish, i.e. a finish insert and an open finish are not limited to the configuration shown. FIG. 8 is a cross-sectional view of another exemplary embodiment of the invention having a two piece finish. The finish insert 802 of this exemplary embodiment is sized in such a way that the retaining ring 118 is part of the finish insert 802 rather than being part of the open finish 804. The sealing surface 806 of the finish insert 802 extends beyond the open neck finish 804 to form the retaining ring 118.

The closure system of the invention can take on various geometries. For convenience, the system has been shown and described as being substantially round in cross section, i.e. cylindrical. However, the invention is not limited to this shape. For example, the neck, neck finish and closure according to the invention can be round, square, rectangular or elliptical in cross section. The closure 104 according to the invention can also take on various shapes. In the embodiment depicted in FIG. 1A, for example, the lower edge of the closure 104 takes on a curvilinear shape. In the embodiment depicted in FIG. 1B, for example, the entire lower edge of the closure forming the lower shoulder 120 can be perpendicular to the sleeve 124. Alternatively, the transition between the long and short part of the lower edge of the closure 104 i.e., the lower shoulder 120, can be more linear than shown in the figures such that a line defined by the lower shoulder 120 forms an angle other than a right angle with respect to the sleeve 124.

Containers utilizing the closure system of the invention can be of any type conventionally used for food products, beverages, household products and the like. In general, the contents of the containers should flow freely so as not to clog or congest the openings 116 in the finish or the receptacle 126 of the closure. Examples of products that can be enclosed in containers utilizing the closure system 100 include motor oil; beverages, such as sports drinks, water or fruit juices; household products, such as liquid soaps, detergents and shampoos; and free flowing powders. The containers typically have a base, a body and a neck located at the opposite end of the body from the base. The body of the container can be of any shape. For example, the container body can be cylindrical, rectangular, or elliptical. The neck can be located in various positions relative to the center line of the body. For example, in typical cylindrical containers used for beverages, the neck is located along the same axis as the body cylinder. In containers with rectangular bodies, the neck can be located along the center line of the body, as shown in FIG. 1A, or it can be offset from the center line, as shown in FIG. 1B. For example, in typical, small motor oil containers, i.e. one liter or one quart containers, have a neck that is near one end of the body and well off the center line. The present invention contemplates all such placements of the neck.

Figure 9:
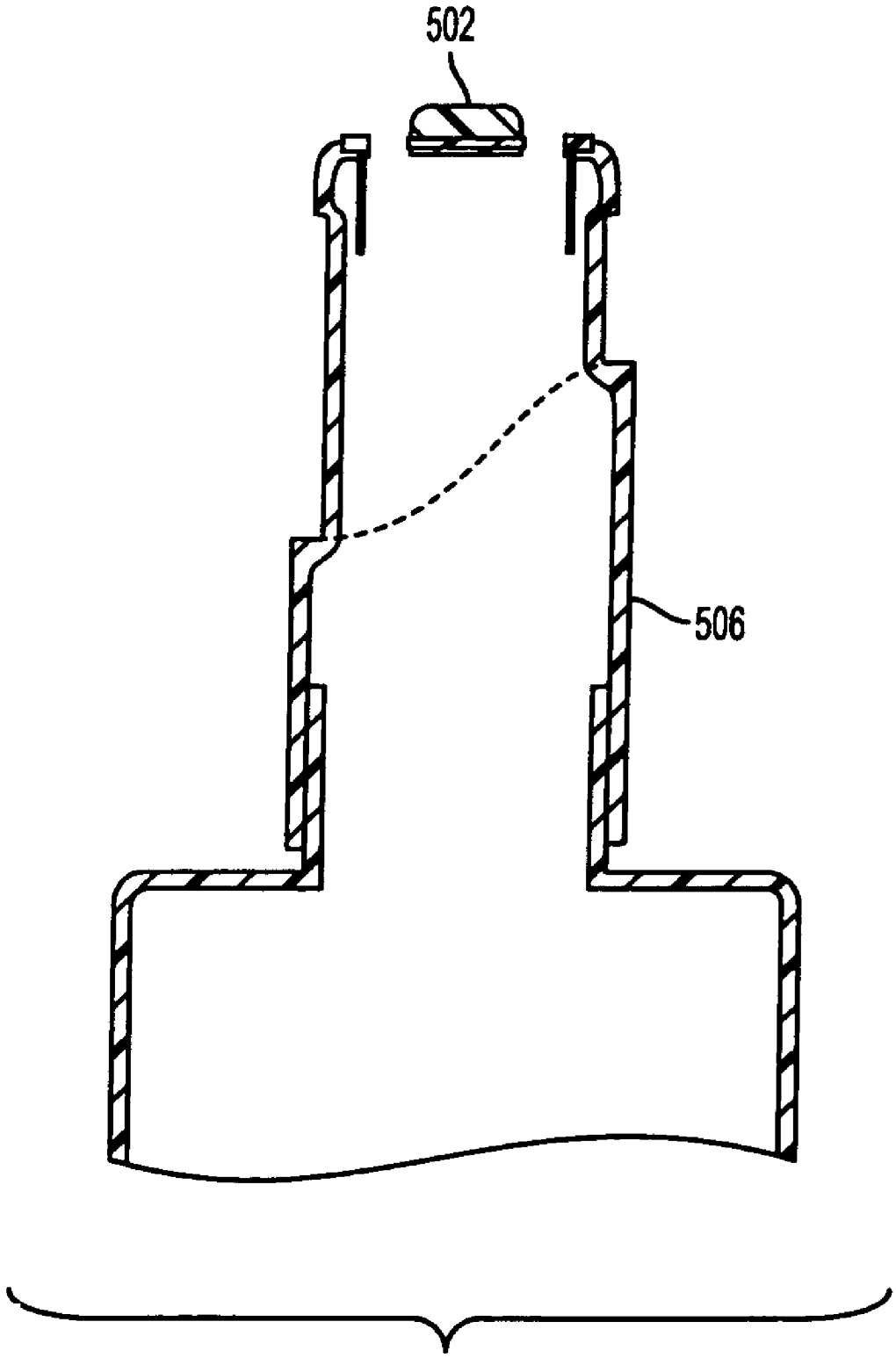
FIG 9. depicts a cross-sectional view of another exemplary embodiment of the invention having a detachable finish.

One or more of the components that make up the system 100 of the invention can be made with the container. For example, the container can include the neck 106 and/or the finish 108. Plastic containers are frequently molded to include both the neck and neck finish. In this case, only the closure would need to be made separately from the container. Alternatively, as shown in FIG. 9, the neck and/or finish can be manufactured as a separate component for later attachment to a container. In such an embodiment, the neck and/or finish can fit over or inside a neck of the container and can be attached to the container by, for example, friction fit, threads, gluing, heating or ultrasonic welding.

The various components of the invention can be made of any material and by any applicable technique as is known in the art. For example, the containers can be glass; plastics such as polyesters, for example polyethylene terephthalate; polyolefins, for example polyethylene or polyproylene; or nylons. Plastic containers can be made by blow molding techniques including extrusion blow molding, injection blow molding and stretch blow molding. Other components, such as the closure 104 and finish insert 506, can be made by these or any other molding technique, for example by injection molding, thermoforming, and extrusion molding. The use of blow molding to form plastic containers is well known in the art.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A resealable closure system comprising:
- a neck and a finish, the finish comprising
  - a first end connected to said neck; and
  - a second end distal to said neck, the second end comprising
    - a post;
    - at least one opening; and
    - a retaining ring;
  - a lower shoulder; and
  - a recess defined by said retaining ring and said lower shoulder; and
- a closure adapted to slidably connect to said neck, the closure comprising
  - a sleeve having an outer dimension substantially equal to an outer dimension of said neck;
  - a stop on an interior surface of said sleeve;
  - a receptacle at an end of the closure to receive said post of said finish when the system is in a closed position; and
  - at least one seal to insert into said at least one opening when the system is in a closed position, wherein said stop inhibits disconnection of said closure and said finish.

2. The system of claim 1, wherein said post is centrally located in said second end of said finish; and said receptacle is centrally located in said closure.

3. The system of claim 1, wherein said lower shoulder is parallel to said retaining ring.

4. The system of claim 1, wherein said lower shoulder is at an angle with respect to said retaining ring.

5. The system of claim 1, wherein the lower shoulder is curvilinear.

6. The system of claim 1, wherein said closure further comprises a thumb push.

7. The system of claim 1, wherein the retaining ring cooperates with said stop to inhibit disconnection of said closure and said finish.

8. The system of claim 1, wherein said neck, said finish and said closure are substantially cylindrical.

9. The system of claim 1, wherein the stop is a first stop and further comprising a second stop.

10. The system of claim 9, wherein, when the system is in a closed position, said second stop is between said retaining ring and said lower shoulder and in contact with said retaining ring and said first stop is between said retaining ring and said lower shoulder, and when the system is in an open position, said retaining ring is between said second stop and said first stop and said first stop is between said retaining ring and said lower shoulder.

11. The system of claim 1, wherein said finish comprises a finish insert, said finish insert comprising said post and said at least one opening; and an open finish, said open finish comprising said lower shoulder and said recess.

12. The system of claim 11, wherein said finish insert comprises said retaining ring.

13. The system of claim 11, wherein said open finish comprises said retaining ring.

14. The resealable closure system of claim 1, wherein said finish is adapted to be detachable from a body of a container.

15. The system of claim 1, wherein said at least one opening is a plurality of openings.

16. A resealable closure system comprising:

a neck and an open finish, the open finish comprising a first end connected to said neck;

a second end distal to said neck, the second end comprising a retaining ring; and a finish insert having a post, at least one opening, a sealing ring at an outer periphery thereof, and a skirt extending perpendicularly from said sealing ring in a direction opposite said post, wherein said skirt is adapted for inserting in an opening of said open finish;

a lower shoulder; and a recess defined by said retaining ring and said lower shoulder; and a closure adapted to slidably connect to said neck, the closure comprising a sleeve having an outer dimension substantially equal to an outer dimension of said neck;

a stop on an interior surface of said sleeve;

a receptacle at an end of the closure to receive said post of said open finish when the system is in a closed position; and at least one seal to insert into said at least one opening when the system is in a closed position, wherein said stop inhibits disconnection of said closure and said open finish.

17. The system of claim 16, said open finish further comprising a ridge defining an opening to accept and engage said skirt; and an upper rim on said ridge defining an inset, wherein said sealing ring is in said inset and in contact with said upper rim and said ridge.

18. A container comprising a base;

a body;

a neck integral with the body; and a finish, the finish comprising a first end integral with said neck; and a second end distal to said neck, the second end comprising a post;

an opening; and a retaining ring;

a lower shoulder; and a recess defined by said retaining ring and said lower shoulder; and a closure adapted to slidably connect to said neck, the closure comprising a sleeve having an outer dimension substantially equal to an outer dimension of said neck;

a stop on an interior surface of said sleeve;

a receptacle at an end of the closure to receive said post of said finish when the closure is in a closed position, wherein said stop inhibits disconnection of said closure and said finish.

19. The container of claim 18, wherein said body is substantially cylindrical.

20. The container of claim 18, wherein said body is rectangular.

21. The container of claim 18, wherein said neck is in a position offset from a center line of said body.

22. The container of claim 18, further comprising a product within the container.

23. The container of claim 18, further comprising a product selected from the group consisting of oil, a detergent, a beverage and a free flowing powder.

24. The container of claim 18, further comprising at least one seal adapted to insert into said opening when the closure is in the closed position.

25. The container of claim 24, wherein said at least one opening is a plurality of openings.

26. A resealable closure arrangement comprising:

a neck and a finish; and a closure slidably connected to said finish;

said finish comprising an end distal to said neck comprising an engaging means for sealingly engaging a receptacle in said closure; and an opening; and a recess; and said closure comprising a sleeve means for slidably connecting to said finish having an outer dimension substantially equal to an outer dimension of said neck; and said receptacle at an end of the closure; and at least one seal to insert into said opening when the arrangement is in a closed position, and the arrangement further comprising a retaining means for retaining the connection of said closure and said finish.

27. The arrangement of claim 26, wherein said engaging means comprises a post.

28. The arrangement of claim 27, wherein said engaging means further comprises a seal on said closure.

29. The arrangement of claim 27, wherein said retaining means further comprises a stop on an inner surface of said sleeve and a retaining ring on said finish.

30. The arrangement of claim 26, wherein said retaining means comprises a stop on an inner surface of said sleeve and a retaining ring on said finish.

31. The arrangement of claim 26, wherein said at least one opening is a plurality of openings.

32. A resealable closure system for a container comprising:

a bottle end including:

a neck having an outer dimension; and a finish, said finish including:

a first end connected to said neck;

a second end distal to said neck including:

a retaining ring having at least one opening therein;

a post; and a lower shoulder, a recess being defined between said retaining ring and said lower shoulder; and a closure slidably engaging said finish, said closure including:

a sleeve having an outer dimension substantially equal to the outer dimension of said neck;

at least one seal for insertion into said at least one opening when the system is in a closed position;

a receptacle therein for receiving said post when the system is in said closed position; and a stop on an interior surface of said sleeve, said stop inhibiting disconnection of said closure and said finish.

33. The resealable closure system for a container of claim 32, wherein said at least one opening is a plurality of openings.

* * * * *